US010428652B2

(12) United States Patent
Ries et al.

(10) Patent No.: US 10,428,652 B2
(45) Date of Patent: Oct. 1, 2019

(54) STRIKE TIP FOR A PICK TOOL HAVING A FLAT APEX AREA

(71) Applicant: ELEMENT SIX GMBH, Burghaun (DE)

(72) Inventors: Bernd Heinrich Ries, Burghaun (DE); Frank Friedrich Lachmann, Burghaun (DE)

(73) Assignee: Element Six GmbH, Burghaun (DE)

( * ) Notice: Subject to any disclaimer, the term of this patent is extended or adjusted under 35 U.S.C. 154(b) by 70 days.

(21) Appl. No.: 14/430,001

(22) PCT Filed: Sep. 27, 2013

(86) PCT No.: PCT/EP2013/070297

§ 371 (c)(1),
(2) Date: Mar. 20, 2015

(87) PCT Pub. No.: WO2014/049162

PCT Pub. Date: Apr. 3, 2014

(65) Prior Publication Data

US 2015/0211366 A1 Jul. 30, 2015

Related U.S. Application Data

(60) Provisional application No. 61/707,309, filed on Sep. 28, 2012.

(30) Foreign Application Priority Data

Sep. 28, 2012 (GB) ..... 1217433.0

(51) Int. Cl.

| | |
|---|---|
| ***E21C 35/18*** | (2006.01) |
| ***E21C 35/183*** | (2006.01) |
| ***E01C 23/12*** | (2006.01) |

(52) U.S. Cl.
CPC ..... *E21C 35/183* (2013.01); *E01C 23/12* (2013.01); *E21C 2035/1806* (2013.01); *E21C 2035/1816* (2013.01)

(58) Field of Classification Search
CPC ..... E21C 2035/1816; E21C 35/183
See application file for complete search history.

(56) References Cited

U.S. PATENT DOCUMENTS

| | | | |
|---|---|---|---|
| 4,880,278 | A | 11/1989 | Tomlinson |
| 5,054,217 | A | 10/1991 | Nilsson et al. |

(Continued)

FOREIGN PATENT DOCUMENTS

| | | | |
|---|---|---|---|
| EP | 2053198 | A1 | 4/2009 |
| GB | 2323398 | A | 9/1998 |

(Continued)

OTHER PUBLICATIONS

International Search Report for PCT/EP2013/070297 dated Oct. 31, 2014.

(Continued)

*Primary Examiner* — Janine M Kreck

(74) *Attorney, Agent, or Firm* — Dean W. Russell; Clark F. Weight; Kilpatrick Townsend & Stockton LLP

(57) ABSTRACT

A strike tip (100) for a pick tool, comprising a strike structure (120) joined to a substrate (110) at an interface boundary (115), the strike structure (120) comprising or consisting or super-hard material and the substrate (110) comprising or consisting of carbide material; the strike tip having a proximate strike end (117) coterminous with the super-hard material and a distal end (118) defined by the substrate (110), a side connecting the strike and distal ends; the strike end (117) including a flat apex area (150) and an outer area extending from the apex to the side. The apex area (Continued)

Figure 1:
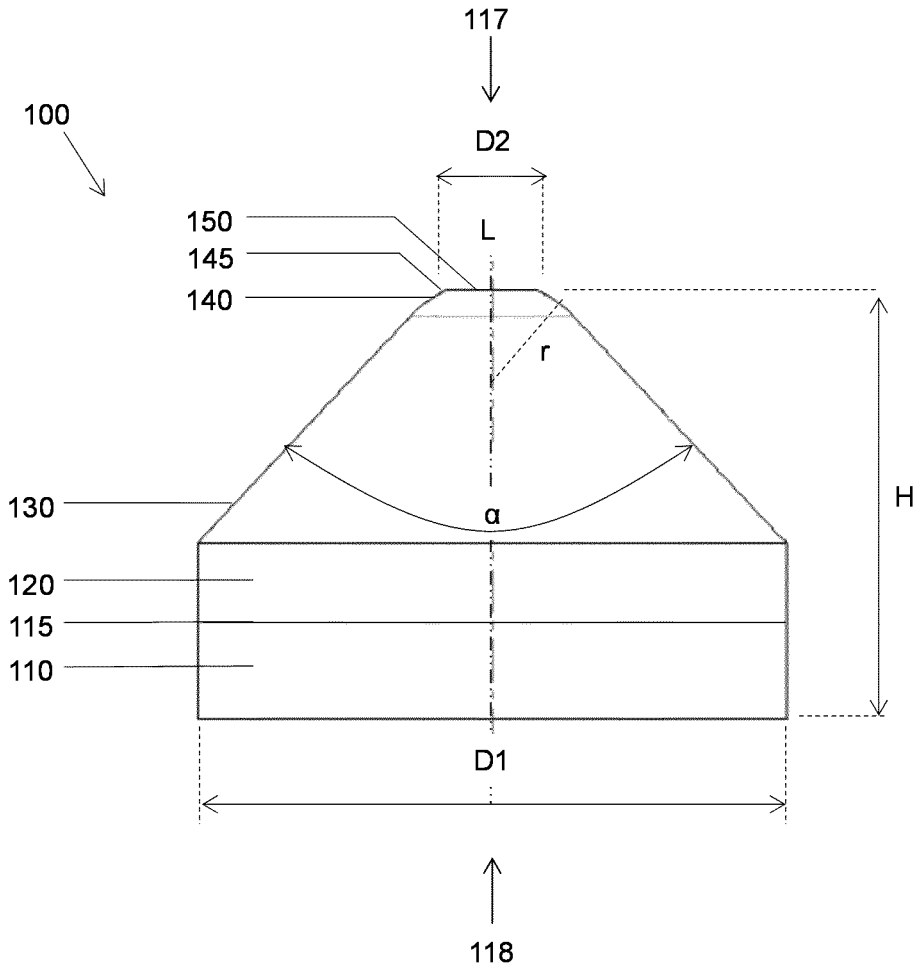

(150) is substantially less than the outer area, and is at least 1 square millimeter and at most 25 square millimeters.

15 Claims, 5 Drawing Sheets

(56) References Cited

U.S. PATENT DOCUMENTS

| | | | | |
|---|---|---|---|---|
| 5,453,105 | A | 9/1995 | Middlemiss et al. | |
| 5,630,479 | A | 5/1997 | Dennis | |
| 5,766,394 | A | 6/1998 | Anderson et al. | |
| 6,003,623 | A | 12/1999 | Miess | |
| 6,179,886 | B1 | 1/2001 | Gordeev et al. | |
| 6,283,844 | B1 * | 9/2001 | Tank | E21B 10/5735 299/111 |
| 6,446,740 | B2 | 9/2002 | Eyre | |
| 6,447,852 | B1 | 9/2002 | Gordeev et al. | |
| 6,709,747 | B1 | 3/2004 | Gordeev et al. | |
| 6,919,040 | B2 | 7/2005 | Fries et al. | |
| 7,008,672 | B2 | 3/2006 | Gordeev et al. | |
| 8,061,457 | B2 | 11/2011 | Hall et al. | |
| 2001/0040053 | A1 * | 11/2001 | Beuershausen | E21B 10/43 175/57 |
| 2003/0052530 | A1 | 3/2003 | Sollami | |
| 2008/0036283 | A1 | 2/2008 | Hall et al. | |
| 2008/0099250 | A1 | 5/2008 | Hall et al. | |
| 2009/0188725 | A1 | 7/2009 | Rai et al. | |
| 2010/0263939 | A1 | 10/2010 | Hall et al. | |

FOREIGN PATENT DOCUMENTS

| | | | |
|---|---|---|---|
| GB | 2324553 | A | 10/1998 |
| GB | 2328963 | A | 3/1999 |
| WO | 97/30263 | A1 | 8/1997 |
| WO | 2008/013713 | A2 | 1/2008 |
| WO | 2008/105915 | A2 | 9/2008 |
| WO | 2011089117 | A2 | 7/2011 |
| WO | 2011089117 | A3 | 7/2011 |

OTHER PUBLICATIONS

UKIPO Search Report for GB1217433.0 dated Oct. 30, 2012.
UKIPO Search Report for GB1317209.3 dated Mar. 27, 2014.
Japanese Patent Application No. 2015-533260, Office Action dated May 6, 2016, 5 pages.

* cited by examiner

STRIKE TIP FOR A PICK TOOL HAVING A FLAT APEX AREA

CROSS REFERENCE TO RELATED APPLICATIONS

This application is the U.S. national phase of International Application No. PCT/EP2013/070297 filed on Sep. 27, 2013, and published in English on Apr. 3, 2014 as International Publication No. WO 2014/049162 A2, which application claims priority to Great Britain Patent Application No. 1217433.0 filed on Sep. 28, 2012, and U.S. Provisional Application No. 61/707,309 filed on Sep. 28, 2012, the contents of both of which are incorporated herein by reference.

This disclosure relates generally to super-hard strike tips for pick tools, pick tool assemblies comprising same, particularly but not exclusively for road milling or mining; and methods of making and using same.

International patent application publication number WO2008/105915 discloses a high impact resistant tool has a super-hard material bonded to a cemented metal carbide substrate at a non-planar interface. At the interface, the substrate has a tapered surface starting from a cylindrical rim of the substrate and ending at an elevated flatted central region formed in the substrate. The super-hard material has a pointed geometry with a sharp apex having 1.27 to 3.17 millimeters radius. The super-hard material also has a 2.54 to 12.7 millimeter thickness from the apex to the flatted central region of the substrate. In other embodiments, the substrate may have a non-planar interface.

U.S. Pat. No. 8,061,457 discloses a high-impact resistant tool comprising a super-hard material bonded to a carbide substrate at a non-planer interface. The super-hard material comprises substantially pointed geometry with a substantially conical portion, the substantially conical portion comprising a tapering side wall with at least two different, contiguous slopes that form an angle greater than 135 degrees. The thickness from an apex of the super-hard material to the non-planer interface is greater than the thickness of the carbide substrate. The volume of the super-hard material may be 75 to 150 per-cent of the volume of the carbide substrate. The thickness from the apex of the super-hard material to the non-planer interface may be greater than twice the thickness of the carbide substrate. The apex of the super-hard material may comprise a radius between 1.27 to 3.17 millimeters.

United States patent application publication number 2010/0263939 discloses a high impact resistant tool comprising a sintered polycrystalline diamond (PCD) body bonded to a cemented metal carbide substrate at an interface. The body comprises a substantially pointed geometry with an apex, and the apex comprises a curved surface that joins a leading side and a trailing side of the body at a first and second transitions respectively. An apex width between the first and second transitions is less than a third of a width of the substrate, and the body also comprises a body thickness from the apex to the interface greater than a third of the width of the substrate.

There is a need for a pick tool comprising a super-hard tip having high material removal efficiency and high resistance to wear and fracture.

Viewed from a first aspect, there is provided a strike tip for a pick tool, comprising a strike structure joined to a substrate at an interface boundary, the strike structure comprising or consisting or super-hard material and the substrate comprising or consisting of carbide material; the strike tip having a proximate strike end coterminous with the super-hard material and a distal end defined by the substrate, a side connecting the strike and distal ends; the strike end including a flat (in other words, substantially planar) apex area and an outer area extending from the apex area to the side; the apex area being substantially less than the outer area, the apex area being at least about 1 square millimeter and at most about 25 square millimeters.

The strike end may be said to comprise a strike surface defined by the super-hard material, the strike surface including the flat apex area and the outer area.

The side may be said to define a central longitudinal axis. In other words, the side will have a shape that has rotational symmetry about the longitudinal axis (the central longitudinal axis may be referred to as a cylindrical axis in a cylindrical coordinate system). The side will extend all the way around the longitudinal axis and may be cylindrical in shape, in some example. In other examples, the side may appear elliptical in shape when viewed in lateral cross section, or it may have some other shape having a centre, through which the central longitudinal axis passes.

The outer area will extend both laterally and longitudinally from the apex area, such that the apex area will be projected longitudinally substantially beyond the side of the strike tip.

The apex area will include at least a point on the strike surface, the point being spaced longitudinally further apart from the interface boundary and or from the distal end of the strike tip than any other point on the strike surface. In some examples, all points on the apex area may be substantially equidistant from the distal base.

Various combinations and arrangements of strike tips and pick tools are envisaged by the disclosure, of which the following are non-limiting and non-exhaustive examples.

In some example arrangements, the apex area may be at least about 2 square millimeters or at least about 3 square millimeters. In some examples, the apex area may be at most about 20 square millimeters or at most about 9 square millimeters.

In some example arrangements, the outer area may be at least about 50 square millimeters or at least about 100 square millimeters. In some examples, the outer area may be at most about 500 square millimeters or at most about 200 square millimeters.

In some example arrangements, the flat apex area may be at least about 0.5 percent or at least about 1 percent of the outer area. In some examples, the flat apex area may be at most about 30 percent or at most about 3 percent of the outer area.

In some example arrangements, the apex area may have a minimum diametrical dimension of at least about 1 millimeter or at least about 2 millimeters; and the apex area may have a maximum diametrical dimension of at most about 5 millimeters or at most about 3 millimeters. As used herein, a diametrical dimension is the distance between a pair of antipodal points of the shape defined by the apex area. In examples where the apex area is substantially circular, the diametrical dimension will be the diameter of the circle.

In some example arrangements, the apex area may be centrally located, such that the central longitudinal axis of the strike tip passes through it.

In some example arrangements, the apex area may be substantially circular, elliptical, square, rectangular or polygonal.

In some example arrangements, the strike structure may comprise a skirt structure depending from and surrounding the apex area.

In some example arrangements, the apex area may be parallel to the distal end of the strike tip; and in other examples, the apex area may substantially non-parallel to the distal end of the strike tip. In some examples, the apex area may be disposed at an angle with respect to the longitudinal axis and or with respect to the distal end of the strike tip. In some examples, the angle may be at least about 5 degrees or at least about 10 degrees; and in some examples, the angle may be at most about 80 degrees or at most about 60 degrees.

In some example arrangements, the strike end (and consequently, the strike surface) may comprise at least one cone surface arranged concentrically with the longitudinal axis (and consequently with the side). The cone surface may extend all the way around the apex area. The cone surface may define a cone angle, being the included angle defined between diametrically opposite sides of the cone surface (in other words, the angle between intersecting opposite tangents to the cone surface, both lying on a longitudinal plane parallel to the longitudinal axis), of at least about 70 degrees or at least about 80 degrees and at most about 120 degrees or at most about 110 degrees.

In some examples, the strike end may define a plurality of cone surfaces, each concentric with the apex area and having a different respective cone angle.

In some examples, at least a portion of the strike end (and strike surface) including the apex area may have a substantially frusto-conical shape.

In some example arrangements, the strike end may include an inner cone surface and an outer cone surface, the inner and outer cone surfaces arranged such that the outer cone surface is relatively more remote from the apex area than the inner cone surface. The inner and outer cone surfaces may be spaced apart by an intermediate surface. In some examples, the intermediate surface may be arcuate in a longitudinal plane.

In some example arrangements, the apex area may be at least partly bounded by an edge formed between the apex area and the outer area. The apex area may be completely surrounded by the edge or the edge may run adjacent part of the apex area, but not necessarily all the way around it. The edge may be a cutting edge for cutting into a body to be degraded (in other words, broken up or disintegrated). The edge may radiused (in which it is rounded), or chamfered.

In some example arrangements, the distal end may have a diameter of 10 to 20 millimeters; the side may be cylindrical in shape; the strike end may include a cone surface surrounding a central flat apex area. The strike end may be substantially frusto-conical in shape.

In some example arrangements, the super-hard material may comprise or consist of polycrystalline diamond (PCD) material. In some examples, at least a region of the strike structure adjacent the apex area may consist of PCD material containing filler material within interstices between diamond grains, the content of the filler material being greater than 5 weight percent of the PCD material in the region. For example, the filler material may comprise catalyst material for diamond, such as cobalt. In some examples, at least a region of the strike structure adjacent the apex area may consist of PCD material containing voids between diamond grains (for example, filler material may have been removed). In some examples, the strike structure may consist of PCD material containing filler material in interstices between diamond grains, the content of the filler material being uniform throughout the strike structure. The strike structure may consist of a single grade of PCD material.

In some example arrangements, the strike structure may comprise a plurality of grades of PCD material. The grades may be arranged as strata in a layered configuration, adjacent strata being directly bonded to each other by intergrowth of diamond grains, or the grades may be arranged in some other configuration.

In some example arrangements, the substrate may comprise an intermediate volume and a distal volume, the intermediate volume disposed between the strike structure and a distal volume and the intermediate volume being greater than the volume of the strike structure and comprising an intermediate material having a mean Young's modulus at least 60 percent that of the super-hard material. The mean Young's modulus of the intermediate material may be at most about 90 percent of that of the super-hard material.

In some examples, the super-hard material may comprise or consist of super-hard grains, such as diamond or cubic boron nitride (cBN) grains, embedded in a matrix comprising or consisting of cemented carbide material or ceramic material.

In various example arrangements, the interface boundary may comprise or consist of generally dome-shaped area, defined by a convex proximate end of the substrate having a radius of curvature in the longitudinal plane of at least about 5 millimeters and at most about 20 millimeters; the interface boundary may include a flat area opposite the apex area; or the interface boundary may include a depression in the substrate opposite the apex area of the strike structure.

In some example arrangements, the thickness of the strike structure between the apex area and the interface boundary opposite the apex may be at least about 2.5 millimeters and at most 10 millimeters. In some examples, the height of the strike tip between the apex area and an opposite end of the strike tip may be at least about 5 millimeters or at least about 9 millimeters.

In some examples, the substrate may comprise or consist of cemented tungsten carbide material including at least about 5 weight percent and at most about 10 weight percent binder material comprising cobalt. In some examples, the substrate may comprise cemented carbide material having Rockwell hardness of at least 88 HRa, transverse rupture strength of at least about 2,500 MPa, magnetic saturation of at least 8 $G \cdot cm^3/g$ and at most 16 $G \cdot cm^3/g$ and coercivity of at least 6 kA/m and at most 14 kA/m.

The pick tool may be for degrading (in other word breaking up, disintegrating or milling) road paving such as asphalt or concrete; or earth or rock formations such as in operations for mining coal or potash.

Viewed from a second aspect, there is provided an assembly for a pick tool (in assembled, partially assembled or unassembled condition), comprising a strike tip according to this disclosure. The pick tool may be for road pavement milling or mining. The pick tool may be for mining coal or potash.

In some example arrangements, the assembly may be attached or attachable to a holder such that the strike structure is substantially prevented from rotating with respect to the holder in use. In example arrangements, the strike tip may be joined to a proximate end of an elongate support body, the support body being shrunk or press fit within a bore provided within a steel base comprised in the holder. In some examples, the support body may comprise cemented carbide material including at least about 5 weight percent and at most about 10 weight percent binder material comprising cobalt. In example arrangements, the support body may comprise cemented tungsten carbide material having Rockwell hardness of at least 90 HRa, and or transverse rupture strength of at least 2,500 MPa, and or magnetic saturation of 7 to 11 $G \cdot cm^3/g$ and or coercivity of at least 6 kA/m and at most 11 kA/m.

Viewed from a third aspect, there is provided a method of using a pick tool comprising a strike tip according to this disclosure, the method including striking a body with the pick tool such that the strike end is driven against the body; in which the body comprises structures dispersed in a matrix, the structures being substantially harder than the matrix.

The structures may be spaced apart from each other by a mean inter-structure spacing of at least about 0.5 millimeters (that is, they may be spaced apart from each other by a statistical distribution of spacing distances, the mean of which may be at least about 0.5 millimeters). In some examples, the mean inter-structure spacing may be at most about 5 millimeters.

The structures may be at least about 1 millimeter in diametrical size (at most about 18 U.S. Mesh); the structures may be at most about 5 millimeters in diametrical size.

In various examples, the body may comprise asphalt; the matrix may comprise tar or potash; and or the structures may comprise gains of stone.

Viewed from a fourth aspect, there is provided a method of making a strike structure according to this disclosure, the method including providing a pre-cursor construction comprising a super-hard structure joined to a substrate at an interface boundary, the super-hard structure comprising or consisting of super-hard material and the substrate comprising or consisting of carbide material; the pre-cursor construction having a proximate end coterminous with the super-hard material and a distal end defined by the substrate, a side connecting the proximate and distal ends; the proximate end including a substantially non-planar apex coterminous with the super-hard material; and processing the super-hard structure to remove a volume (of the super-hard structure) including the non-planar apex, such that the proximate end includes a flat apex area and an outer area extending from the apex area to the side; the apex area being substantially less than the outer area, the apex area being at least about 1 square millimeter and at most about 25 square millimeters.

In some examples, the non-planar apex of the pre-cursor construction may be spherically rounded in shape. It may have a radius of curvature in a longitudinal plane, which may be about 1 to 6 millimeters.

The shape of the proximate end of the pre-cursor construction may comprise that of a spherically blunted cone, coterminous with the super-hard material, and the processing of the super-hard structure may result in the proximate end having a generally frusto-conical shape.

In some examples, the processing may include cutting through the super-hard structure, for example by means of wire electro-discharge machining (EDM), and or grinding the apex area. The method may include processing an edge between the flat apex area and the outer area, to provide an intermediate area between the flat apex area and the outer area. The method may include processing the edge to provide a bevel or chamfer at the edge.

Figure 2:
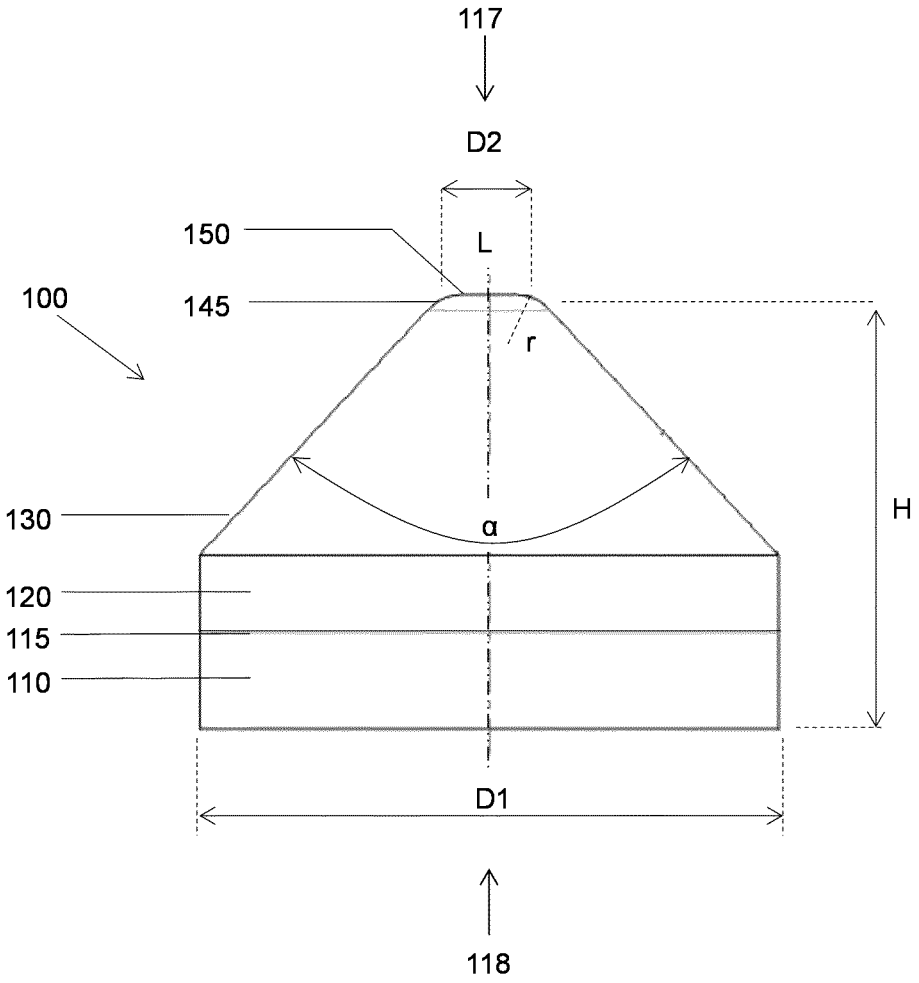
Figure 3:
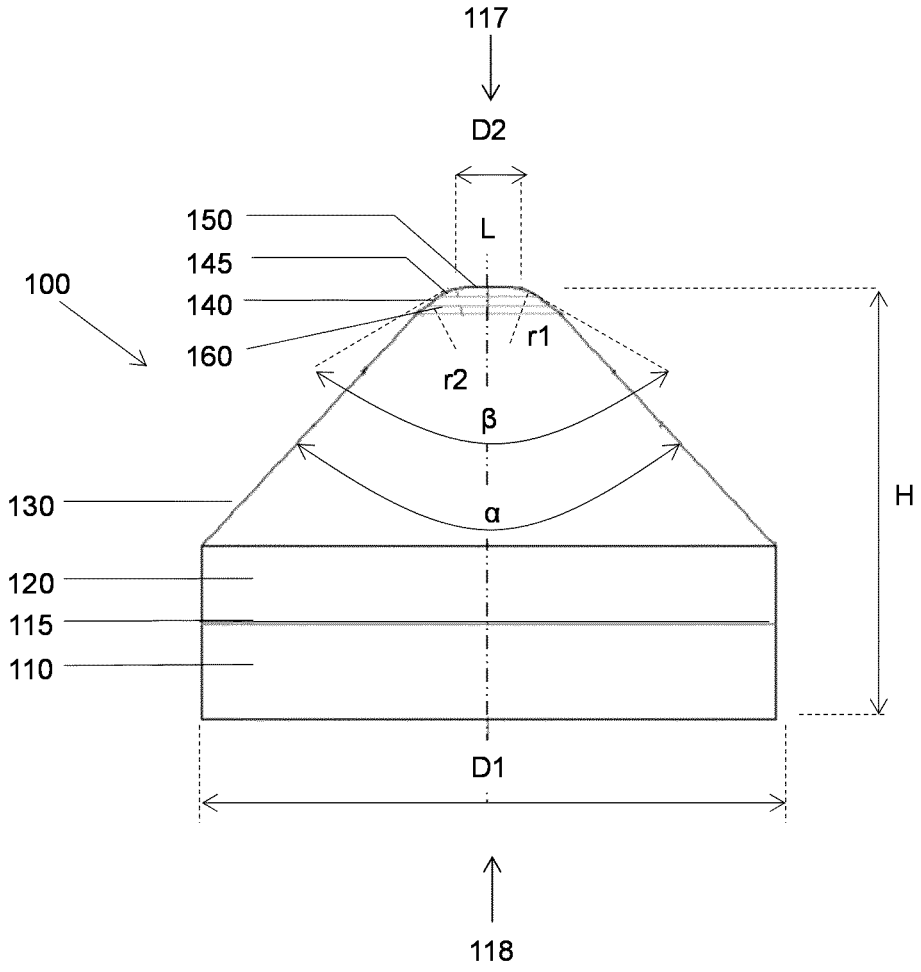
Figure 4:
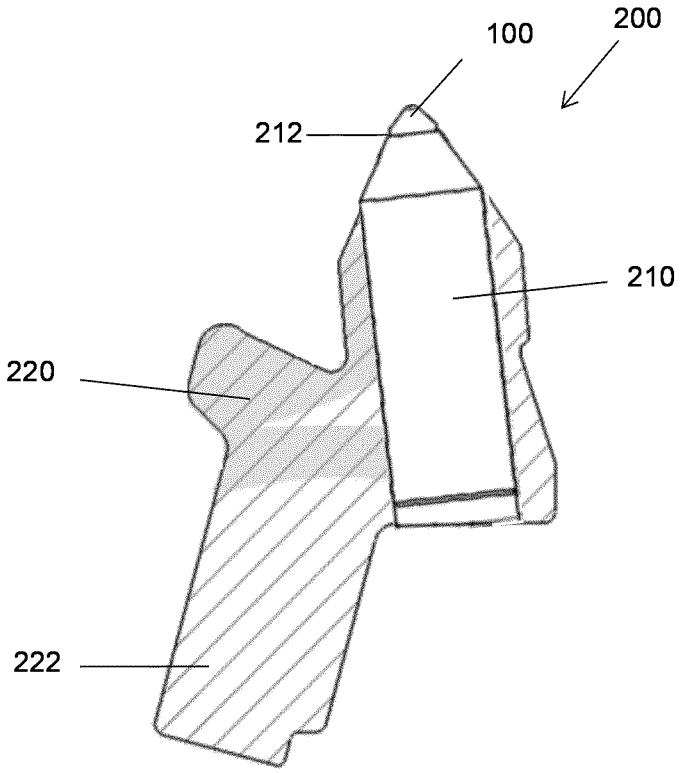
Figure 5:
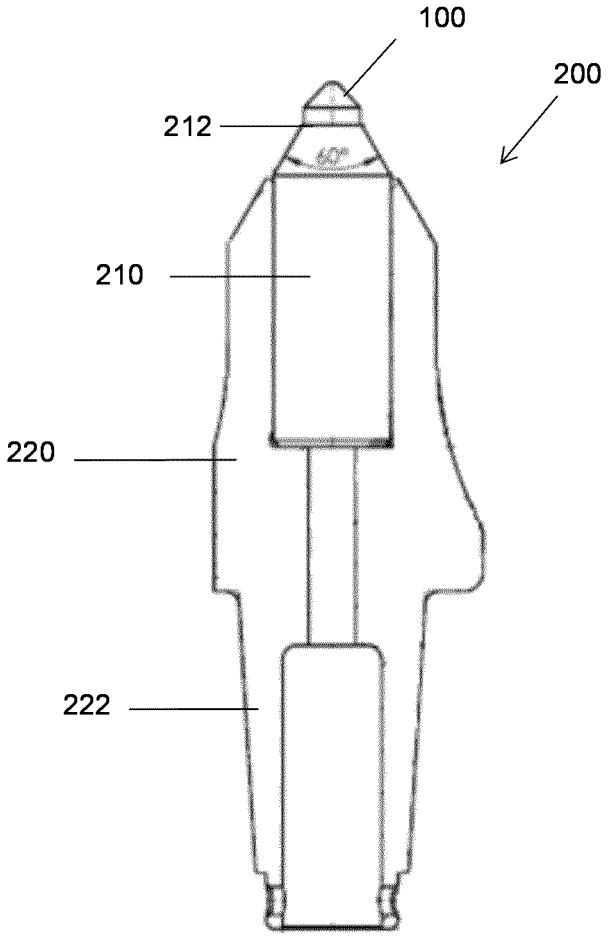

Non-limiting example arrangements are described with reference to the accompanying drawings, of which FIG. 1, FIG. 2 and FIG. 3 show schematic side views of example strike tips;

FIG. 4 and FIG. 5 show schematic cross section views of example pick tools.

With reference to FIG. 1, FIG. 2 and FIG. 3, example strike tips 100 for a pick tool (not shown) each comprise a respective strike structure 120 joined to a substrate 110 at an interface boundary 115, the strike structures 120 each comprising polycrystalline diamond (PCD) material and the substrates 110 comprising cobalt-based cemented carbide material. Each strike structure 120 has a generally protruding proximate strike end 117 opposite the interface boundary 115 and a distal end 118 of the strike tip 100, the strike end 117 and distal end 118 being connected by a cylindrical side defining a central longitudinal axis L. Each strike end 117 is defined by the PCD material and includes a flat apex area 150 bounded by respective edges 145 extending all the way around the peripheries of the apex areas 150. Each of the strike structures 110 has a respective major cone surface 130 concentric with the apex area 150 (and the longitudinal axis L) and defining a cone angle $\alpha$ of about 86 degrees. Each strike tip 100 has a maximum diameter D1 of about 12 millimeters and an overall height H of about 9 millimeters from the apex area 150 to the opposite end 118 of the strike tip 100. In these particular examples, the strike area 150 is a flat circular surface with diameter D2 and is substantially parallel to the distal end 118 of the strike tip 100.

With particular reference to FIG. 1, the edge 145 of the apex area 150 is formed between the apex area 150 and a rounded surface area 140 of the strike structure 120, in which the rounded surface 140 is arcuate in a longitudinal plane parallel to the longitudinal axis L. The rounded surface area 140 has a radius of curvature r of about 2.25 millimeters and is intermediate the apex area 150 and the major cone surface 130. The circular apex area 150 has a diameter D2 of about 1.9 millimeters.

With particular reference to FIG. 2, the edge 145 of the strike area 150 is radiused, defining a radius of curvature r in a longitudinal plane of about 1 millimeter. The radiused edge 145 is formed between the apex area 150 and the major cone surface 130. The strike end 117 thus defines a substantially frusto-conical shape with a radiused (rounded) transition between the cone surface 130 and the apex area 150. The circular apex area 150 has a diameter D2 of about 1 millimeter.

With particular reference to FIG. 3, the edge 145 of the strike area 150 is radiused, defining a radius of curvature r1 in a longitudinal plane of about 1 millimeter. The circular apex area 150 has a diameter D2 of about 1 millimeter. The strike end 117 includes an inner cone surface 140 and an outer cone surface 130 (being the major cone surface), the cone surfaces 130, 140 arranged such that the outer cone surface 130 is relatively more remote from the apex area 150 than the inner cone surface 140. The inner 140 and outer 130 cone surfaces are spaced apart by an intermediate surface 160 that is axially arcuate, having a radius of curvature r2 of 1 millimeter, and is concentric with the inner 140 and outer 130 cone surfaces. The inner cone surface 140 defines an included cone angle $\beta$ of about 110 degrees, which is substantially greater than the cone angle $\alpha$ of 86 degrees defined by the outer (major) cone surface 130.

In the examples illustrated in FIG. 1, FIG. 2 and FIG. 3, the strike structures 120 consist of polycrystalline diamond (PCD) material comprising inter-grown diamond grains. The interstices between the diamond grains are substantially filled with filler material comprising cobalt, the content of the filler material being about 10 weight percent throughout the strike structure, including adjacent the strike surface 130. In other examples, the content of the filler material in a volume of the PCD material adjacent the apex area 150 may be substantially less than 10 weight percent, and may be less than 2 weight percent.

With reference to FIG. 4 and FIG. 5, example pick tools 200 each comprise a strike tip 100 joined to a support body 210 at a join interface boundary 212, and the support body 210 comprises an insertion shaft, which is shrink fit into a bore formed into a steel base 220. The base 220 has a shank 222 for mounting the pick 200 onto a drum (not shown) via a coupling mechanism (not shown). In the example arrangement shown in FIG. 4, the shank 222 is substantially not aligned with the support body 210, while in the example arrangement shown in FIG. 5, the shank 222 is generally aligned with the support body 210. The volume of the support body 210 may be about 30 $cm^3$ and the length of the support body 210 may be about 6.8 cm. As used herein, a shrink fit is a kind of interference fit between components achieved by a relative size change in at least one of the components (the shape may also change somewhat). This is usually achieved by heating or cooling one component before assembly and allowing it to return to the ambient temperature after assembly. Shrink-fitting is understood to be contrasted with press-fitting, in which a component is forced into a bore or recess within another component, which may involve generating substantial frictional stress between the components. In some variants, the support body 210 comprises a cemented carbide material comprising grains of tungsten carbide having a mean size of at about 2.5 microns to about 3 microns, and at most about 10 weight percent of metal binder material, such as cobalt (Co). Shrink fitting the support body 210 into the base 220 may allow relatively stiff grades of cemented carbide to be used, which is likely to enhance support for the tip 100 and reduce the risk of fracture. In order to reduce stresses, sharp corners at points of contact may be avoided. For example, edges and corners may be radiused or chamfered, and the edge of the bore may be provided with a radius or chamfer to reduce the risk of stress-related cracks arising.

In use, the strike end of the strike tip will be driven to impact a body or formation to be broken up. The strike tip may be comprised in a pick tool may be driven to impact a body or formation to be degraded. In road milling or mining, a plurality of picks each comprising a respective strike tip may be mounted onto a drum. The drum will be coupled to and driven by a vehicle, causing the drum to rotate and the picks repeatedly to strike the asphalt or rock, for example, as the drum rotates. The picks may generally be arranged so the each strike tip does not strike the body directly with the top of the apex, but somewhat obliquely to achieve a digging action in which the body is locally broken up by each strike tip. Repeated impact of the strike tip against hard material is likely to result in the abrasive wear and or fracture of the strike tip and or other parts of the pick.

Synthetic and natural diamond, polycrystalline diamond (PCD), cubic boron nitride (cBN) and polycrystalline cBN (PCBN) material are examples of super-hard materials. As used herein, synthetic diamond, which is also called man-made diamond, is diamond material that has been manufactured. As used herein, polycrystalline diamond (PCD) material comprises an aggregation of a plurality of diamond grains, a substantial portion of which are directly inter-bonded with each other and in which the content of diamond is at least about 80 volume percent of the material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains. As used herein, a PCD grade is a variant of PCD material characterised in terms of the volume content and or size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

Example methods for making a tip comprising a PCD structure formed joined to a substrate will now be described.

In general, a strike tip may be made by placing an aggregation comprising a plurality of diamond grains onto a cemented carbide substrate in the presence of a catalyst material for diamond, thus providing a pre-sinter assembly, which may then be subjected to an ultra-high pressure and high temperature at which diamond is more thermodynamically stable than graphite, to sinter together the diamond grains and form a PCD structure joined to the substrate body. Binder material within the cemented carbide substrate body may provide a source of the catalyst material, such as cobalt, iron or nickel, or mixtures or alloys including any of these. A source of catalyst material may be provided within the aggregation of diamond grains, in the form of admixed powder or deposits on the diamond grains, for example. A source of catalyst material may be provided proximate a boundary of the aggregation other than the boundary between the aggregation and the substrate body, for example adjacent a boundary of the aggregation that will correspond to the strike end of the sintered PCD structure.

In some example methods, the aggregation may comprise substantially loose diamond grains, or diamond grains held together by a binder material. The aggregations may be in the form of granules, discs, wafers or sheets, and may contain catalyst material for diamond and or additives for reducing abnormal diamond grain growth, for example, or the aggregation may be substantially free of catalyst material or additives.

In some example methods, aggregations in the form of sheets comprising a plurality of diamond grains held together by a binder material may be provided. The sheets may be made by a method such as extrusion or tape casting, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. Alternative methods for depositing diamond-bearing layers include spraying methods, such as thermal spraying. The binder material may comprise a water-based organic binder such as methyl cellulose or polyethylene glycol (PEG) and different sheets comprising diamond grains having different size distributions, diamond content and or additives may be provided. For example, sheets comprising diamond grains having a mean size in the range from about 15 microns to about 80 microns may be provided. Discs may be cut from the sheet or the sheet may be fragmented. The sheets may also contain catalyst material for diamond, such as cobalt, and or precursor material for the catalyst material, and or additives for inhibiting abnormal growth of the diamond grains or enhancing the properties of the PCD material. For example, the sheets may contain about 0.5 weight percent to about 5 weight percent of vanadium carbide, chromium carbide or tungsten carbide.

In some versions of the example method, the aggregation of diamond grains may include precursor material for catalyst material. For example, the aggregation may include metal carbonate precursor material, in particular metal carbonate crystals, and the method may include converting the binder precursor material to the corresponding metal oxide (for example, by pyrolysis or decomposition), admixing the metal oxide based binder precursor material with a mass of diamond particles, and milling the mixture to produce metal oxide precursor material dispersed over the surfaces of the diamond particles. The metal carbonate crystals may be selected from cobalt carbonate, nickel carbonate, copper carbonate and the like, in particular cobalt carbonate. The catalyst precursor material may be milled until the mean particle size of the metal oxide is in the range from about 5 nm to about 200 nm. The metal oxide may be reduced to a metal dispersion, for example in a vacuum in the presence of carbon and/or by hydrogen reduction. The controlled pyrolysis of a metal carbonate, such as cobalt carbonate crystals provides a method for producing the corresponding metal oxide, for example cobalt oxide ($Co_3O_4$), which can be reduced to form cobalt metal dispersions. The reduction of the oxide may be carried out in a vacuum in the presence of carbon and/or by hydrogen reduction.

A substrate body comprising cemented carbide in which the cement or binder material comprises a catalyst material for diamond, such as cobalt, may be provided. The substrate body may have a non-planar or a substantially planar proximate end on which the PCD structure is to be formed. For example, the proximate end may be configured to reduce or at least modify residual stress within the PCD. A cup having a generally conical internal surface may be provided for use in assembling the diamond aggregation, which may be in the form of an assembly of diamond-containing sheets, onto the substrate body. The aggregation may be placed into the cup and arranged to fit substantially conformally against the internal surface. The substrate body may then be inserted into the cup with the proximate end going in first and pushed against the aggregation of diamond grains. The substrate body may be firmly held against the aggregation by means of a second cup placed over it and inter-engaging or joining with the first cup to form a pre-sinter assembly.

The pre-sinter assembly can be placed into a capsule for an ultra-high pressure press and subjected to an ultra-high pressure of at least about 5.5 GPa and a temperature of at least about 1,300 degrees centigrade to sinter the diamond grains and form a construction comprising a PCD structure sintered onto the substrate body. In one version of the method, when the pre-sinter assembly is treated at the ultra-high pressure and high temperature, the binder material within the support body melts and infiltrates the aggregation of diamond grains. The presence of the molten catalyst material from the support body and or from a source provided within the aggregation will promote the sintering of the diamond grains by intergrowth with each other to form a PCD structure.

The pre-sinter assembly may be configured such that the PCD structure has a proximate end (opposite a distal interface boundary with the substrate) that includes an apex having a rounded shape, or some other non-flat shape. A volume of the PCD structure including the apex may be cut or ground off, by means of electro-discharge machining, for example.

In other examples, the super-hard material may include certain composite materials comprising diamond or cBN grains held together by a matrix comprising ceramic material, such as silicon carbide (SiC), or cemented carbide material, such as Co-bonded WC material (for example, as described in U.S. Pat. No. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

Disclosed strike tips and picks comprising them may have the aspect of good working life and efficient degradation capability. A relatively sharp geometrical transition between the apex area and an outer surface of the strike end may allow for greater efficiency in removing material from a body to be degraded, since the this feature may allow for greater penetration of the edge of the strike structure into the body on impact (in other words, there may be an enhanced digging action). This effect may be greater in examples where a relatively sharp edge is formed between the apex area and the outer area of the strike surface. However, there may be a higher risk of fracture of the strike structure at or proximate the apex area or its edge, potentially as a result of high impact stresses in these areas. Enhanced cutting action on the one hand needs to be balanced with limiting the risk of fracture on the other. In addition, while a flat apex area may present an sharper edge for initial cutting of the body on impact, the strike surface needs to be configured for adequate penetration of the strike tip into the body after the initial cut has been made in the body. Therefore, the apex area should not be too high in relation to the outer area, since the strike tip as a whole should present a generally "pointed" geometry to the body to achieve sufficient follow-through penetration. A radiused or chamfered cutting edge defined by the apex area would likely be more resistant to fracture on impact that a sharper, more abrupt edge.

In examples where strike tips are used to break up bodies comprising hard structures, such as stones, dispersed within a softer matrix structure, the configuration of the strike end in general and the apex area in particular may be selected according to the composition of the body. For example, picks comprising strike tips according to this disclosure may be used to break up road or pavement bodies comprising asphalt, which may comprise grains of stones dispersed with in a tar-based matrix. The strike structure may be selected to have an strike surface configured according to the statistical distributions of the sizes of the grains and the distances between the stones, such that the effect of digging out the stones may be enhanced. For example, the apex area, its edge and the surrounding surfaces of the strike end may ne configured to increase the likelihood of the apex area fitting between the stones and to increase the cutting of the matrix on impact.

Where the weight or volume percent content of a constituent of a polycrystalline or composite material is measured, it is understood that the volume of the material within which the content is measured is to be sufficiently large that the measurement is substantially representative of the bulk characteristics of the material. For example, if PCD material comprises inter-grown diamond grains and cobalt filler material disposed in interstices between the diamond grains, the content of the filler material in terms of volume or weight percent of the PCD material should be measured over a volume of the PCD material that is at least several times the volume of the diamond grains so that the mean ratio of filler material to diamond material is a substantially true representation of that within a bulk sample of the PCD material (of the same grade).

The invention claimed is:

1. A strike tip for a pick tool, comprising a strike structure joined to a substrate at an interface boundary, the strike structure comprising polycrystalline diamond (PCD) material and the substrate comprising carbide material, the strike tip having a proximate strike end coterminous with the PCD material, a distal end defined by the substrate, and a side connecting the strike and distal ends;

the distal end having a diameter of between 10 to 20 millimeters and the strike end including a flat apex area and an outer area extending from the apex area to the side, the outer area defining a partial conical surface arranged concentrically with the side, the partial conical surface having a cone angle of 80° to 110°, wherein the thickness of the strike structure between the apex area and the interface boundary opposite the apex area is 2.5 to 10 mm, the apex area being less than the outer area and having a minimum diametrical dimension of 1 millimeter and a maximum diametrical dimension of 3 millimeters, wherein the apex area is at least partly bounded by an edge formed between the apex area and the outer area.

2. A strike tip as claimed in claim 1, in which the outer area is 50 to 500 square millimeters.

3. A strike tip as claimed in claim 1, in which the flat apex area is 0.5 to 30 percent of the outer area.

4. A strike tip as claimed in claim 1, in which the apex area is centrally located, and a central longitudinal axis of the strike tip passes through it.

5. A strike tip as claimed in claim 1, in which the apex area is substantially circular.

6. A strike tip as claimed in claim 1, in which the apex area is parallel to the distal end of the strike tip.

7. A strike tip as claimed in claim 1, in which the apex area is disposed at an angle of at least 5 degrees with respect to the distal end of the strike tip.

8. A strike tip as claimed in claim 1, in which the strike end includes a plurality of cone surfaces, each concentric with the apex area and having a different respective cone angle.

9. A strike tip as claimed in claim 1, in which at least a portion of the strike end including the apex area has a substantially frusto-conical shape.

10. A strike tip as claimed in claim 1, in which the PCD material comprises PCD grains embedded in a matrix comprising cemented carbide material or ceramic material.

11. A strike tip as claimed in claim 1, in which the substrate comprises cemented tungsten carbide material including at least 5 weight percent and at most 10 weight percent binder material comprising cobalt.

12. An assembly for a pick tool for road pavement milling or mining, comprising a strike tip as claimed in claim 1.

13. A method of using a pick tool comprising a strike tip as claimed in claim 1, the method including striking a body with the pick tool such that the strike end is driven against the body; in which the body comprises structures dispersed in a matrix, the structures being substantially harder than the matrix and are spaced apart from each other by a mean inter-structure spacing of 0.5 to 5 millimeters.

14. A method as claimed in claim 13, in which the structures are 1 to 5 millimeters in diametrical size.

15. A method as claimed in claim 13, in which the body comprises asphalt, the matrix comprises tar or potash or the structures comprise stone.

* * * * *